US009010957B2

(12) United States Patent
Tseng

(10) Patent No.: US 9,010,957 B2
(45) Date of Patent: Apr. 21, 2015

(54) CONTROL CIRCUIT DEVICE

(71) Applicant: Shen-Ko Tseng, Taipei (TW)

(72) Inventor: Shen-Ko Tseng, Taipei (TW)

( * ) Notice: Subject to any disclaimer, the term of this patent is extended or adjusted under 35 U.S.C. 154(b) by 0 days.

(21) Appl. No.: 14/067,504

(22) Filed: Oct. 30, 2013

(65) Prior Publication Data

US 2014/0118996 A1 May 1, 2014

(30) Foreign Application Priority Data

Oct. 31, 2012 (CN) ..... 2012 2 0565352 U

(51) Int. Cl.

| | |
|---|---|
| ***F21V 23/00*** | (2006.01) |
| ***H05B 33/08*** | (2006.01) |
| ***F21S 9/02*** | (2006.01) |
| *F21V 23/04* | (2006.01) |
| *F21Y 101/02* | (2006.01) |
| *F21Y 113/00* | (2006.01) |

(52) U.S. Cl.

CPC ..... *H05B 33/0863* (2013.01); *F21S 9/02* (2013.01); *F21V 23/0442* (2013.01); *F21Y 2101/02* (2013.01); *F21Y 2113/005* (2013.01); *H05B 33/0857* (2013.01)

(58) Field of Classification Search

CPC ... F21L 4/02; H05B 33/0857; H05B 33/0863; F21Y 2101/02; F21Y 2113/005; F21S 9/02; F21V 23/0442; F21V 23/00; F21V 23/04; F21V 23/0485; F21V 23/003; F21V 23/006–23/009

See application file for complete search history.

(56) References Cited

U.S. PATENT DOCUMENTS

| | | | | |
|---|---|---|---|---|
| 7,387,411 | B1 * | 6/2008 | Tsai | 362/392 |
| 2004/0136186 | A1 * | 7/2004 | Hsu | 362/208 |
| 2008/0037251 | A1 * | 2/2008 | Leslie et al. | 362/251 |
| 2009/0059576 | A1 * | 3/2009 | Coushaine et al. | 362/205 |
| 2010/0320758 | A1 * | 12/2010 | Sisk | 285/420 |

* cited by examiner

*Primary Examiner* — Bao Q Truong

(57) ABSTRACT

A control circuit device includes a lighting unit, a battery, an insulating sheet, a triggering slice, and a control module. The insulating sheet is configured on a first electrode of the battery and forms an opening. A fixed portion of the triggering slice is configured on the insulating sheet, while a contact portion of the triggering slice extends to the opening to make contact with the first electrode through the opening by pressing the triggering slice. A first control unit of the control module is connected to the first electrode and second electrode of the battery, and the light unit to receive electric power from the battery and control when the light unit emits light. A second control unit of the control module is connected to the triggering slice, the second electrode, and the first control unit to receive power when the triggering slice is made in contact with the first electrode to switch on or off the first control unit.

10 Claims, 5 Drawing Sheets

CONTROL CIRCUIT DEVICE

BACKGROUND OF THE INVENTION

1. Field of the Invention

The present invention relates to a control circuit device, more particularly, to a control circuit device that can be set on a wearable device and emit light.

2. Description of the Prior Art

As we move towards more convenient lifestyles, our material objects tend to improve as well. In the society we live in today, material objects are not only looked at for their functionality but their aesthetics as well. For example, designers have been setting devices that can emit light on shoes, clothing and accessories, just to make it stand out and flashy. In recent times, the most common type of control circuit devices that emit light on articles of clothing are LEDs. It is because of its rapidly improving technology and flexibility in the ways it emits light that it has become popular in creating special light patterns in apparel such as clothing or shoes.

The LEDs mentioned above are controlled by a printed circuit board with a control circuit device, where the printed circuit board triggers the LEDs to emit light through vibration. The control circuit device has a power supply, which is usually a button battery, set on the printed circuit board to supply power to the printed circuit board and LEDs and allowing them to operate. For example, users can put on shoes which have an embedded control circuit device with a vibration detector and then proceed to walk, run, or jump. The vibration detector on the printed circuit board of the control circuit device will then detect the vibration made from the actions and control the LEDs to emit light.

However, the vibration detector embedded in the wearable device too sensitive in detecting vibration and will usually emit light when there was only a slight vibration. For example, when a user sets the wearable device on a table, the vibration detector may detect vibration from other activities on the table and then signal the LEDs to emit light. This causes power drain on the battery due to LEDs emitting light when not necessary, which in turn may cause the LED to have no power left when it is needed.

SUMMARY OF THE INVENTION

The present invention proposes a control circuit device to solve the problem mentioned in prior art.

According to an embodiment of the invention, the control circuit device comprises a lighting unit, a battery, an insulating sheet, a triggering slice and a control module. The insulating sheet is configured on the first electrode of the battery and forms an opening to expose part of the first electrode of the battery. The triggering slice has a fixed portion and a contact portion. The fixed portion is configured on the insulating sheet, and the contact portion is configured on the opening of the insulating sheet. The control module comprises a first control unit and a second control unit, wherein the first control unit is electrically connected to the first electrode of the battery, the second electrode of the battery, and the lighting unit that controls the electric power received from the battery to emit light. The second control unit is electrically connected to the triggering slice, the second electrode of the battery and the first control unit.

In this embodiment, users can press the triggering slice to make the contact portion go through the opening of the insulating sheet and then contact to the first electrode of the battery. When the triggering slice contacted to the first electrode of the battery, the second control unit received the power from the battery and switching the first control unit.

Many other advantages and features of the present invention will be further understood by the following detailed description and the appended drawings.

BRIEF DESCRIPTION OF THE APPENDED DRAWINGS

To facilitate understanding, identical reference numerals have been used, where it is possible to designate identical elements in the descriptions of the embodiments that are common to the figures.

DETAILED DESCRIPTION OF THE INVENTION

A detailed description of the described embodiments of the disclosed apparatus and method are presented by way of exemplification and not limitation with reference to the Figures. Although certain embodiments are shown and described in detail, it should be understood that various changes and modifications may be made while still maintaining the ideas and teachings of the appended claims. The scope of the present invention is in no way limited to the number of constituting components, the materials thereof, the shapes thereof, the relative arrangement thereof, etc., and are disclosed simply as an example of possible embodiments of the present invention.

Figure 1A:
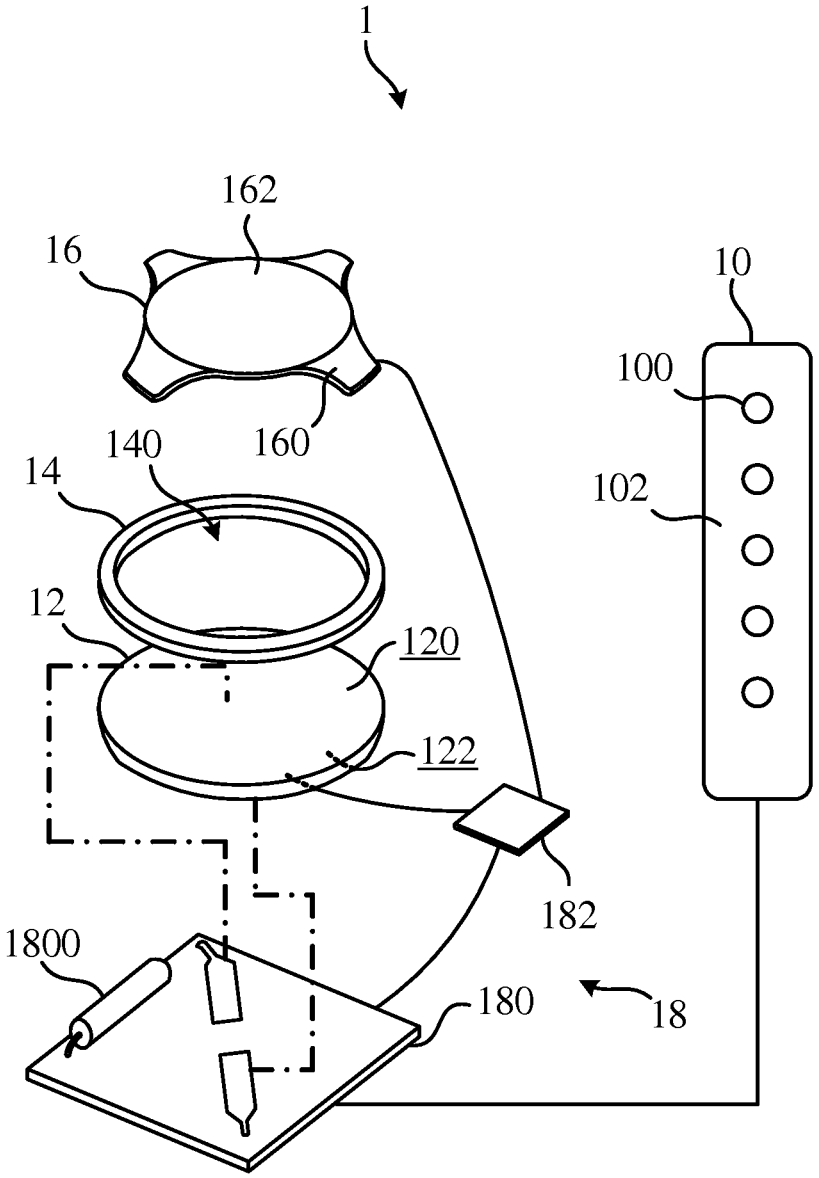
FIG. 1A is a schematic diagram illustrating the control circuit device according to an embodiment of the invention.

Please refer to FIG. 1A. FIG. 1A is a schematic diagram illustrating the control circuit device 1 according to an embodiment of the invention. According to some embodiments of the invention the control circuit device 1 comprises a lighting unit 10, battery 12, insulating sheet 14, triggering slice 16 and control module 18. In this embodiment, the control circuit device 1 can be set on any wearable device, such as shoes, hats, backpacks, arm rings or foot rings to achieve LED lighting that can serve for warning purposes or decoration.

In this embodiment, the battery 12 is a circular battery. The two surfaces of the battery 12 have different polarities, wherein one polarity is the first electrode of the battery 120, and the other polarity is the second electrode of the battery 122. The control module 18 has a first control unit 180 and a second control unit 182. The first control unit 180 is electrically connected to the first electrode of the battery 120, the second electrode of the battery 122 and the lighting unit 10. This allows the first control unit 180 to receive power from the battery 12 and then output the power to the lighting unit 10. The first control unit 180 can then control the lighting unit 10 to emit light with the received power.

Figure 1B:
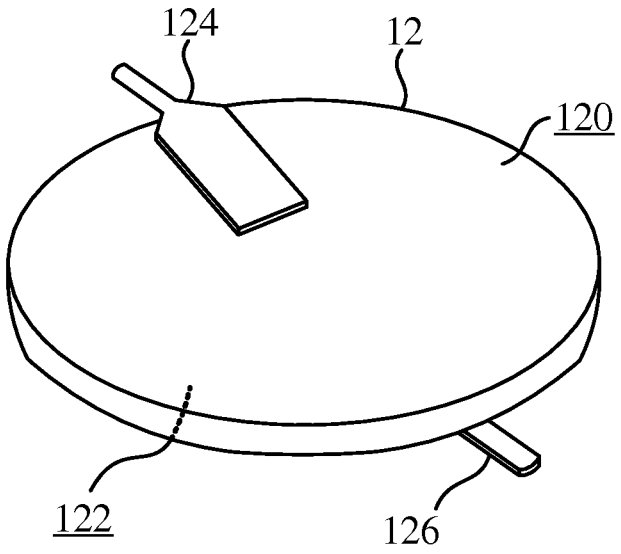
FIG. 1B is a schematic diagram illustrating the first slice and the second slice soldered on the battery according to an embodiment of the invention.

Please refer to FIG. 1A and FIG. 1B. FIG. 1B is a schematic diagram illustrating the first slice 124 and the second slice 126 soldered on the battery 12 for a according to an embodiment of the invention. The control circuit device 1 receives power from the battery 12 from the first slice being electrically connecting to the first electrode of the battery 120 and the second slice 126 being electrically connecting to the second electrode of the battery 122. As shown in FIG. 2B, one side of the first slice 124 is connected to the first electrode of the battery 120 through soldering (such as spot-welding), and one side of the second slice 126 connected to the second electrode of the battery 122 also through soldering. When the battery 12 is set on the first control unit 180, the other sides of the first slice 124 and the second slice 126 can then be electrically connected to the first control unit 180 by soldering.

In this embodiment, the lighting unit 10 can have one or a plurality of lighting elements. For example, in FIG. 1A the lighting unit 10 has five lighting elements 100. This invention is not limited to the amount of the lighting elements 100. The amount of the lighting elements 100 can be adjusted according to the user or the designer's requirements. The first control unit 180 can control the five lighting elements 100 in FIG. 1A to emit light in a specific order, such as from top to bottom, and generate a light pattern. Aside from that, each of the lighting elements 100 can also have different colors, such as blue, green or red LEDs, and the first control unit 180 can be a drive ID for LEDs. Thus, when the first control unit 180 controls each lighting element 100 to emit lights in proper order, the lighting unit 10 can create a colorful effect by emitting lights of different color.

The lighting unit 10 further has a soft substrate 102 to support the lighting element 100. The soft substrate 102 can be set on a circuit to connect every lighting element 100 together and allow the lighting element 100 to receive power and control from the first control unit 180 to emit light. In other embodiments of the invention, the soft substrate 102 can be set on a wearable device's surface. Because of the flexibility of the soft substrate 102, the lighting unit 10 can be changed to be in form with the wearable device. This allows the user to feel more comfortable and protects the lighting unit 10 from damage.

In this embodiment, the first control unit 180 comprises a detector 1800 to detect the motion of the control circuit device 1 and then to generate a detecting signal. According to the detecting signal, the first control unit 180 can control the light unit 10 to emit light. In detail, the detector 1800 can be a ball switch or a vibration switch. When a user wears the device, set the control circuit device 1, and begins to exercise, the detector 1800 can detect the motion of the control circuit device 1 and generate the corresponding detecting signal.

Figure 1C:
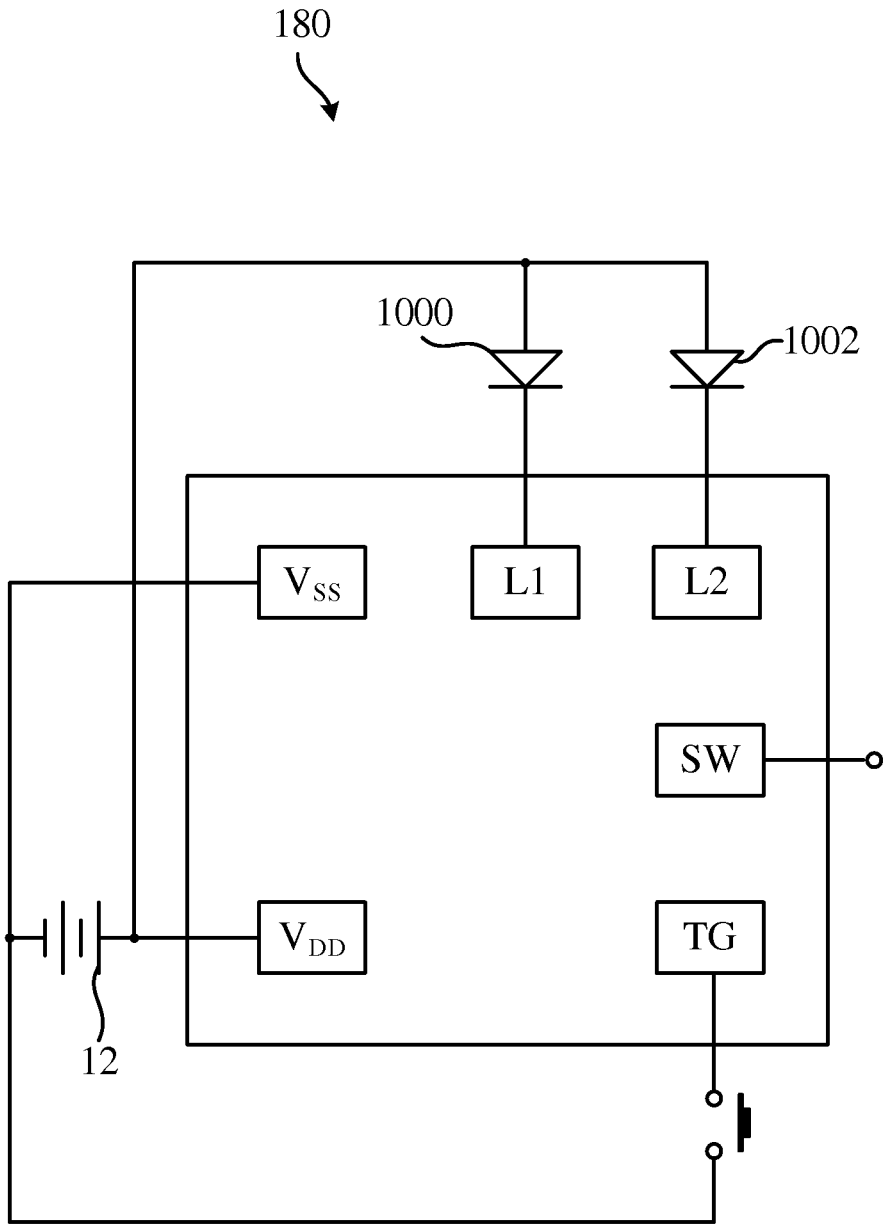
FIG. 1C is a schematic diagram illustrating the control circuit device in FIG. 1A, wherein the first control unit is electrically connected to the lighting elements.

According to the above embodiment, each of the lighting units 100 can be of a different color, such as blue, green or red LEDs. The different color LEDs may need different voltages or currents. Please refer to FIG. 1C, FIG. 1C shows the first control unit electrically connected to the lighting elements for a predetermined embodiment of FIG. 1A. According to FIG. 1C, the first control unit 180 has a switch SW, function button TG, working voltage VDD, grounding end VSS, first LED output end L1 and second LED output end L2.

In this embodiment, the switch SW is electrically connected to the second control unit 182 to allow the second control unit 182 control over the switch of the first control unit 180. The function button TG can connect to the detector 1800. The detector 1800 can generate a detecting signal to control the working voltage VDD and the grounding end VSS to receive power from the battery 12 and allow the first control unit 180 control over the lighting unit 100 to emit light. The first LED output end L1 and the second LED output end L2 can specifically connect to the first lighting element 1000 and the second lighting element 1002 of the lighting element 100 to output the driving current (or driving voltage) to the first lighting element 1000 and the second lighting element 1002. Noticeably, FIG. 1C only shows 2 lighting element and 2 LED outputs. It could also extend to other lighting elements 100 in FIG. 1A. In this embodiment, the amount of lighting elements and LEDs on the first control unit can be adjusted by the user or designer's requirement. This invention does not limit the amount that can be used.

The first LED output end (or terminal) L1 can output a first working current (or voltage) to the first lighting element 1000 when the first control unit 180 is in operation. The second LED output end (or terminal) L2 can output a first working current (or voltage) to the second lighting element 1002 when the first control unit 180 is in operation. When the first lighting element 1000 has different color LEDs from the second lighting element 1002, for example, a blue LED and red LED, that have different working conditions, the first LED output end L1 and the second LED output end L2 can output a different first working current (or voltage) and second working current (or voltage) in coordination. In other words, the first LED output end can output a different polarity to the second LED output end. So, according to the requirements of different lighting elements, the first control unit 180 is able to generate a suitable working output.

Please refer to FIG. 1A again. According to FIG. 1A, the second control unit 182 is electrically connected to the triggering slice 16, the second electrode of the battery 122 and the first control unit 180. In this embodiment, the second control unit 182 is configured away from the first control unit 180. But in practical cases, the second control unit 182 can be fixed on the first control unit 180 or on the lighting unit 10. Furthermore, the first control unit can be divided into two parts. The first part is fixed on the battery to receive the power from the battery. The second part is set on the lighting unit to control the lighting unit and combined with the second control unit on the lighting unit.

The insulating sheet 14 is set on the first electrode of the battery 120. The central area of the insulating sheet 14 has an opening for displaying part of the first electrode of the battery 120. In an embodiment according to the invention, the insulating sheet 14 is a ring-type insulating sheet. The ring-type insulating sheet comprising an outer ring and an inner ring, wherein the diameter of the outer ring is approximately equal to the diameter of the circular battery. The triggering slice 16 has a fixed portion 160 and a contact portion 162, where the fixed portion 160 is configured on the insulating sheet 14, and the contact portion 162 is configured on the opening of the insulating sheet 140. For example, a ring-type insulating sheet with the fixed portion 160 fixed on the ring of the ring-type insulating sheet and the contact portion 162 is configured on the opening of the insulating sheet 140. There is no connection to the first electrode of the battery 120. In practical cases, the form of the insulating sheet and the triggering slice are not limited to the embodiment illustrated in FIG. 1A, as it can be adjusted by the user or the designer's requirement. For example, in another embodiment, the opening of the insulating sheet is set on the edge instead the central area, where the contact portion can be extended to the opening of the insulating sheet's edge.

Figure 2A:
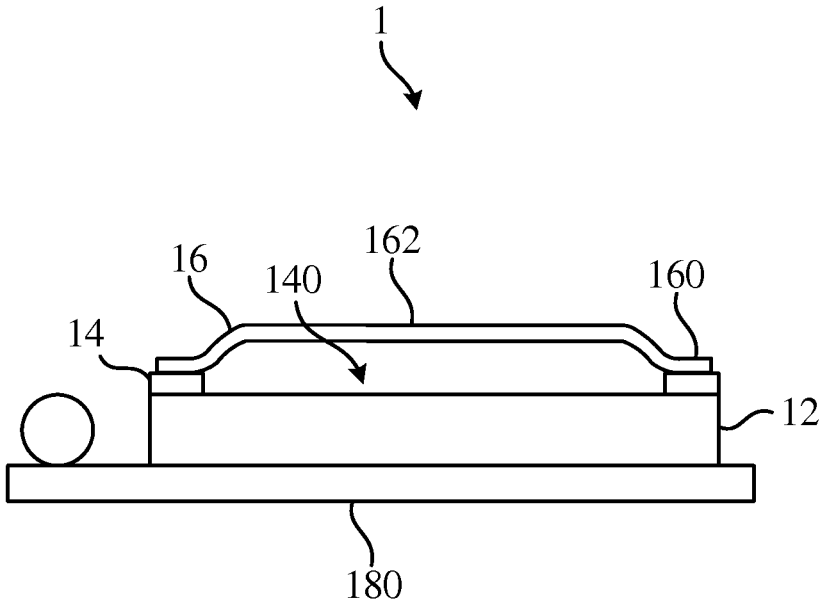
FIG. 2A is a schematic diagram illustrating the cross-sectional view of the control circuit device in FIG. 1A.
Figure 2B:
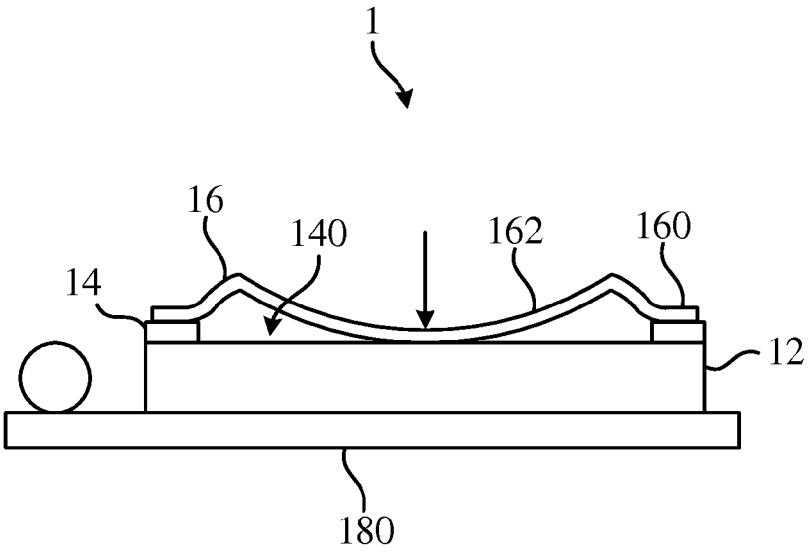
FIG. 2B is a schematic diagram illustrating the cross-sectional view of the triggering slice pressed and in contact with the battery in the embodiment of FIG. 2A.

Please refer to FIG. 1A and FIG. 2A. FIG. 2A is a schematic diagram illustrating the cross-sectional view of the control circuit device 1 for a predetermined embodiment of FIG. 1A. In FIG. 2A, the contact portion 162 has no connection with the battery 12 when the triggering slice 16 has not been loaded, while the fix portion 160 of the triggering slice 16 is configured on the insulating sheet 14. Thus, the second control unit 182 will not receive power from the battery 12.

Please refer to FIG. 1A and FIG. 2B. FIG. 2B is a schematic diagram illustrating the cross-sectional view of the triggering slice pressed and made in contact with the battery for a predetermined embodiment according to FIG. 2A. In FIG. 2B, the user can press the contact portion 162 of the triggering slice 16 vertically to deform the triggering slice 16 so that the contact portion 162 can go through the opening of the insulating sheet 140 to be made in contact with the first electrode of the battery 120. This allows the second control unit 182 to receive the power from the battery 12 through the triggering slice 16 and the second electrode of the battery 122.

The second control unit 182 can operate and switch open the first control unit 180 while receiving the power from the battery 12. In detail, when the user presses the contact portion 162 to be made in contact with the first electrode of the battery 120, the second control unit 182 receives power and begins to operate. The second control unit 182 can then switch the first control unit 180 open. This will then allow the first control unit 180 the ability to detect the motion of the control circuit device 1 and emit light by controlling the lighting unit 10. When the user presses the contact portion 162 again to be made in contact with the first electrode of the battery 120, where the second control unit 182 switches the first control unit 180 off after receiving the power.

Through the second control unit 182, the user can control the control circuit device 1 to emit light whenever necessary. For example, if the control circuit device 1 is set on a pair of jogging shoes, the user can press the contact portion 62 to cause the second control unit 182 to switch on the first control unit 180 when the user decides to go jogging. The lighting unit 10 will then emit a light for lighting, warning or decoration while the user is jogging. When the jogging is finished, the user can press the contact portion 162 again and cause the second control unit 182 to switch off the first control unit 180, thus controlling the first control unit 180 to emit light when necessary and avoid wasting power.

Figure 3:
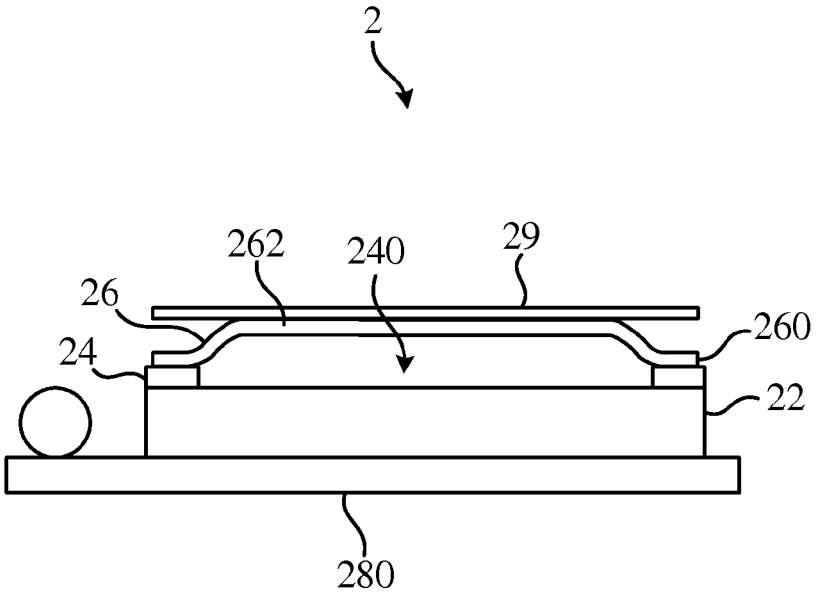
FIG. 3 is a schematic diagram illustrating the cross-sectional view of the control circuit device in another predetermined embodiment.

Please refer to FIG. 3. FIG. 3 is a schematic diagram illustrating the cross-sectional view of the control circuit device 2 in another predetermined embodiment. In FIG. 3, the embodiment is different from the embodiment mentioned above because the control circuit device 2 further comprises a contact washer 29, which is set on the triggering slice 26. User can press the contact washer 29 to cause the contact portion 262 to make contact with the first electrode of the battery. The contact washer 29 can be fabricated by an insulation material to prevent the contact washer 29 from directly contacting the triggering slice 26 when pressed and affecting the electrical property of the control circuit device 1 to not harm the user. In this embodiment, the other devices of the control circuit device 2 are the same as the embodiment mentioned above. In this embodiment, a waterproofing plastic can cover the triggering slice, battery, first control unit and the second control unit to achieve waterproofing.

According to the above, the present invention proposes a control circuit device is not only comprised of a first control unit that can detect vibration and control the lighting unit to emit light but also a second control unit that can switch the first control unit on or off to control when the control circuit device emits light. The second control unit can switch on or off the first control unit by controlling when the triggering slice is electrically contacting to one polarity of the battery. Thus, the proposed invention, a control circuit device, can control when to emit light, preventing wasted power With the examples and explanations mentioned above, the features and spirits of the invention are hopefully well described. More importantly, the present invention is not limited to the embodiment described herein. Those skilled in the art will readily observe that numerous modifications and alterations of the device may be made while still retaining the teachings of the invention. Accordingly, the above disclosure should be construed as limited only by the metes and bounds of the appended claims.

What is claimed is:

1. A control circuit device, comprising:

a lighting unit;

a battery, comprising a first electrode and a second electrode;

an insulating sheet, configured on the first electrode of the battery and forms an opening to expose part of the first electrode of the battery;

a triggering slice, having a fixed portion and a contact portion, the fixed portion configured on the insulating sheet, the contact portion configured on the opening of the insulating sheet to be made in contact with the first electrode of the battery through the opening by a user's corresponding press; and a control module, comprising a first control unit and a second control unit, the first control unit electrically connected to the battery and the light unit to control the electric power received from the battery to emit light, the second control unit connected to the triggering slice and the first control unit to receive the electric power from the battery when the triggering slice is made in contact with the first electrode of the battery and switching on/off the first control unit.

2. The control circuit device of claim 1, wherein the battery is a circular battery, the insulating sheet is a ring-type insulating sheet comprising an outer ring and an inner ring, wherein the diameter of the outer ring is approximately equal to the diameter of the circular battery.

3. The control circuit device of claim 1, wherein the lighting unit further comprises:

a soft substrate for configuring a plurality of LEDs.

4. The control circuit device of claim 3, wherein the plurality of LEDs comprises a first LED and a second LED, wherein the working condition of the first LED is different from the working condition of the second LED.

5. The control circuit device of claim 4, wherein the first control unit has a first terminal and a second terminal respectively connected to the first LED and the second LED, wherein the output polarity of the first terminal is different from the output polarity of the second terminal.

6. The control circuit device of claim 1, wherein the first control unit further comprises a detector for detecting the motion of the control circuit device to generate a detecting signal, the first control unit controls the lighting unit to emit light according to the detecting signal.

7. The control circuit device of claim 6, wherein the detector is a ball switch.

8. The control circuit device of claim 6, wherein the detector is a vibration switch.

9. The control circuit device of claim 1 further comprises a contact washer, set on the triggering slice for a user to press.

10. The control circuit device of claim 1, wherein when the triggering slice is made in contact with the first electrode of the battery, the second control unit controls the first control unit to be in an "on" status, when the triggering slice is made in contact with the first electrode of the battery again, the second control unit controls the first control unit to be in an "off" status.

* * * * *